US010138657B2

(12) United States Patent
Bendel et al.

(10) Patent No.: US 10,138,657 B2
(45) Date of Patent: Nov. 27, 2018

(54) MOTOR VEHICLE DOOR LOCK

(71) Applicant: Kiekert Aktiengesellschaft, Heiligenhaus (DE)

(72) Inventors: Thorsten Bendel, Oberhausen (DE); Armin Handke, Duisburg (DE); Matthias Ochtrop, Dorsten (DE); Michael Herrmann, Neukirchen-Vluyn (DE); Andreas Sohlbach, Mulheim (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 582 days.

(21) Appl. No.: 14/761,094

(22) PCT Filed: Jan. 16, 2013

(86) PCT No.: PCT/DE2013/000021
§ 371 (c)(1),
(2) Date: Jul. 15, 2015

(87) PCT Pub. No.: WO2014/111070
PCT Pub. Date: Jul. 24, 2014

(65) Prior Publication Data
US 2015/0345192 A1 Dec. 3, 2015

(51) Int. Cl.
*E05B 85/24* (2014.01)
*E05B 85/26* (2014.01)
(Continued)

(52) U.S. Cl.
CPC ..... *E05B 85/243* (2013.01); *E05B 79/10* (2013.01); *E05B 85/26* (2013.01); *E05B 77/36* (2013.01); *Y10T 292/1075* (2015.04)

(58) Field of Classification Search
USPC ..... 292/194, 216
See application file for complete search history.

(56) References Cited

U.S. PATENT DOCUMENTS 6,328,354 B1 * 12/2001 Dejean ..... E06B 85/243 292/116
6,568,721 B2 * 5/2003 Fisher ..... E05B 17/007 292/199
(Continued)

FOREIGN PATENT DOCUMENTS

DE 4219420 C1 11/1993
DE 10156200 A1 6/2003
(Continued)

OTHER PUBLICATIONS

Machine Translation of DE10156200A1 by Lexis Nexis Total Patent on Jul. 29, 2015.
(Continued)

*Primary Examiner* — Carlos Lugo
(74) *Attorney, Agent, or Firm* — Woodard, Emhardt, Moriarty, McNett & Henry LLP

(57) ABSTRACT

The invention relates to a motor vehicle door lock, with a locking mechanism consisting of a rotary latch and a pawl, wherein, in the closed state of the locking mechanism, the pawl bears with the locking contour thereof against a latching contour of the rotary latch, wherein the locking contour is formed in two parts with a retaining contour and a rolling contour.

20 Claims, 4 Drawing Sheets

(51) Int. Cl.
*E05B 79/10* (2014.01)
*E05B 77/36* (2014.01)

(56) References Cited

U.S. PATENT DOCUMENTS

| | | | | |
|---|---|---|---|---|
| 7,210,714 | B2 * | 5/2007 | Berghahn | E05B 81/20 292/201 |
| 7,441,815 | B2 * | 10/2008 | Umino | E05L 381/06 292/201 |
| 8,528,950 | B2 * | 9/2013 | Organek | E05B 17/007 292/216 |
| 2001/0015558 | A1 * | 8/2001 | Fisher | E05L 377/10 292/216 |
| 2004/0135378 | A1 * | 7/2004 | Buedding | E05B 81/20 292/216 |
| 2015/0115626 | A1 * | 4/2015 | Bendel | E06B 85/26 292/195 |

FOREIGN PATENT DOCUMENTS

| | | | |
|---|---|---|---|
| DE | 29912524 | U1 | 11/2003 |
| DE | 102009029031 | A1 | 3/2011 |
| DE | 102009029041 | A1 | 3/2011 |
| DE | 202012000134 | U1 | 6/2013 |

OTHER PUBLICATIONS

Machine Translation of DE102009029031A1 by Lexis Nexis Total Patent on Jul. 29, 2015.
Machine Translation of DE102009029041A1 by Lexis Nexis Total Patent on Jul. 29, 2015.
Machine Translation of DE202012000134U1 by Lexis Nexis Total Patent on Jul. 29, 2015.
Machine Translation of DE29612524U1 by Google Patent on Jul. 29, 2015.
Machine Translation of DE4219429C1 by Google Patent on Jul. 29, 2015.

* cited by examiner

MOTOR VEHICLE DOOR LOCK

CROSS-REFERENCE TO RELATED APPLICATIONS

This application is the U.S. national stage application of International Patent Application No. PCT/DE2013/000021, filed Jan. 16, 2013, which is hereby incorporated by reference.

BACKGROUND

The invention relates to a motor vehicle door latch, with a locking mechanism comprising a catch and a pawl, whereby the pawl is adjacent to a ratchet contour of the catch with its bolting contour when the locking mechanism is closed.

The locking mechanism of a motor vehicle door latch is a core component of the latch because ultimately the locking mechanism ensures that a pertaining motor vehicle door is bolted and secured vis-à-vis the vehicle chassis. For this purpose, the locking mechanism comprising the catch and pawl is usually of a solid steel construction in order to be able to absorb significant forces arising at this point. In fact, for example a latch containing a locking mechanism is located inside a motor vehicle side door and typically interacts with a closure pin on the motor vehicle chassis, for example a B column.

Due to the relevance to safety of locking mechanisms, in the state of the art there have already been attempts to provide an improvement taking into account safety-related aspects and to intercept distortions in particular. In this context DE 42 19 429 C1 instructs a latch with a catch which can be activated by a locking bolt. The catch can be locked into place in a pre-ratchet and a main ratchet position by means of a pawl. The pawl not only demonstrates a blocking element, but also a safety blocking element.

In a similar way to the side door latches previously described, the tailgate latches are also constructed in which the latch is accommodated with the locking mechanism inside the tailgate, whereas the pertaining locking bolt is accommodated on a loading sill. Such tailgate latches or latches for the tailgate are now regularly motorically opened. For this purpose, a pertaining drive unit works on the pawl and lifts it out. Consequently, the catch is typically opened in a spring-supported manner and releases the locking bolt and thus the tailgate vis-à-vis the motor vehicle chassis.

Within the scope of the category-defining DE 296 12 524 U1 equipment is described for closing and tightening and opening a tailgate flap on a motor vehicle chassis. At this point a tightening lever is mounted on an escutcheon co-axially to the catch. The pawl is arranged eccentrically to the catch on the tightening lever and can thus be mechanically lifted off from the catch with the aid of the tightening lever. In actual fact, a mechanical coupling of the tightening function and the pawl activation is achieved in the conventional knowledge.

As the catch and pawl are solid for the reasons already described, 'clack' noises which are unwanted and considered bothersome often occur when the pawl is lifted off from the catch. These are often further supported and reinforced by the fact that the tailgate seals a boot space volume which acts or can act as a resonance volume in this regard. The invention intends to provide an overall remedy here.

SUMMARY

The invention is based on the technical problem of further developing a motor vehicle door latch of the design described at the outset in such a way that the noise behaviour of the locking mechanism is improved overall, whereby the emphasis is on minimising any noises when the pawl is lifted from the catch as far as possible.

In order to solve the technical problem, a type-appropriate motor vehicle door latch within the scope of the invention is characterised in that the bolting contour is of a two-part design with a holding contour and an unrolling contour, whereby the holding contour predominantly interacts with the ratchet contour in the closed state of the locking mechanism, whereas the unrolling contour also in the opening process of the catch on the ratchet contour and if necessary also on a handle of the catch rolls off, consequently the opening catch is lifted off practically noiselessly from the unrolling sill of the pawl.

Within the scope of the invention the pawl is consequently equipped with a special bolting contour. The bolting contour fundamentally comprises the holding contour and the unrolling contour which are of different designs. In fact, the holding contour in the closed state of the locking mechanism ensures that the pawl fulfils its original function by the holding contour interacting with the ratchet contour of the catch. The ratchet contour of the catch can demonstrate a pre-ratchet and a main ratchet overall or be designed as a pre-ratchet or main ratchet contour, whereby the catch in the pertaining ratchet positions is respectively supported on the holding contour of the pawl.

Independent of this holding contour, the pawl also has an unrolling contour in accordance with the invention, whereby the holding contour and the unrolling contour define the locking contour overall. The unrolling contour is not generally assigned a supportive or locking effect. Instead, the unrolling contour of the pawl only comes into action when the catch has already started its opening process, i.e. has left the closed position or state. In this case, the holding contour on the pawl and the ratchet contour on the catch are not or predominantly no longer enmeshed.

Now during this opening process of the catch the unrolling contour ensures—starting from the closed state of the locking mechanism—that the ratchet contour and if necessary also a leg of the catch can roll off onto the unrolling contour. In accordance with the invention and consciously, mechanical contact of the catch with the pawl takes place beyond the actual closed position and the associated supportive effect of the holding contour vis-à-vis the ratchet contour. On the one hand the unrolling contour on the pawl and on the other hand the shifting ratchet contour or the additional leg on the catch are responsible for this.

As a consequence of this, the opening catch and the unrolling contour of the pawl and consequently the pawl as a whole successively veer away from one another. Consequently, overall any 'clack' noises or other mechanical noises no (longer) occur or are reduced to a minimum.

In order to be able to achieve this in detail, the holding contour and the unrolling contour in general are joined to one another on the catch-side end of the pawl. The holding contour is usually joined to the unrolling contour in the lifting out direction of the pawl. The lifting out direction of the pawl usually corresponds to a pivoting movement around a pertaining rotational axis. This pivoting movement of the pawl can be initiated mechanically and manually with a lever.

Within the scope of the invention however a drive unit for its motorised lifting out is usually assigned to the pawl. This means that the drive unit ensures that the pawl is lifted out and also specifies the lifting-out direction of the pawl. In the process, the pawl overall performs the already discussed pivoting movement around the rotational axis. Opposite the rotational axis or the rotational axis-side end of the pawl, the catch-side end of the pawl is located with the holding contour and unrolling contour provided for there.

It is usually designed in such a way that the unrolling contour in the lifting-out direction of the pawl at least partially protrudes radially over the holding contour. In detail, the unrolling contour protrudes radially over the holding contour in the corresponding lifting-out direction of the pawl in general to an increasing or progressive extent. This means that with the increasing pivot angle of the pawl around its rotational axis the radial distance between the holding contour and the unrolling contour also becomes larger, progressively increases. Thus, the invention takes into account the circumstance that the opening catch and the pawl pivoted in the lifting-out direction are increasingly distanced from one another in their contact area. Here the invention now creates an adjustment due to the fact that the unrolling contour progressively radially protrudes over the holding contour.

In detail it is designed in such a way that the unrolling contour in the lifting out direction of the pawl at least partly overlaps with the catch in its closed state. Usually the unrolling contour in the corresponding lifting out direction overlaps with the ratchet contour on the catch and if necessary the leg of the catch in its closed state. This overlap takes into account the circumstance that the pawl and the catch generally become distanced from one another when the catch is opened. In order to be able to guarantee, in accordance with the invention, a mechanical contact beyond the closed state, the pawl of the catch lags so to speak. This is principally attained by the unrolling contour in the lifting-out direction of the pawl overlapping with the catch or with the ratchet contour and if necessary the handle of the catch which the pawl glides along during the described opening movement with the unrolling contour.

The unrolling contour and the holding contour are respectively typically formed as circular arcs. One regularly works with different radii and/or different centre points for the unrolling contour on the one hand and the holding contour on the other hand. Generally, the radius of the unrolling contour exceeds that of the holding contour so that the unrolling contour can correspond to the already described function of the 'lag' in relation to the opening movement of the catch.

The centre point of the unrolling contour and the centre point of the holding contour are usually at a distance from one another. In general it is envisaged that the centre point of the holding contour is arranged below the rotational axis of the pawl and the centre point of the unrolling contour above the rotational axis. Furthermore, the respective centre points and the rotational axis are preferably on a common connecting section.

As a result, a motor vehicle door latch is provided with a locking mechanism comprising a pawl and a catch which can be opened in a particularly low-noise manner. The low-noise nature is attained due to the fact that the pawl and the catch—starting from the closed state of the locking mechanism—demonstrate a mechanical contact beyond this state. This mechanical contact is produced on the one hand by the unrolling contour of the pawl and on the other hand the ratchet contour of the catch and if necessary also a leg of the catch. Furthermore, it is designed in such a way that the adjacent contours slowly and not abruptly change their distance from both the pawl and the catch. Consequently, overall an especially 'soft' transition from the closed state of the locking mechanism via the subsequent opening movement with unchanged mechanical contact between the pawl and the catch, until finally the separation between the catch and the pawl, is observed. This movement process is associated with special acoustic advantages.

Hereinafter, the invention is explained in further detail on the basis of a sketch which only depicts an execution example; FIG. 1 and FIG. 2 show the following:

DETAILED DESCRIPTION OF THE DRAWINGS

Figure 1:
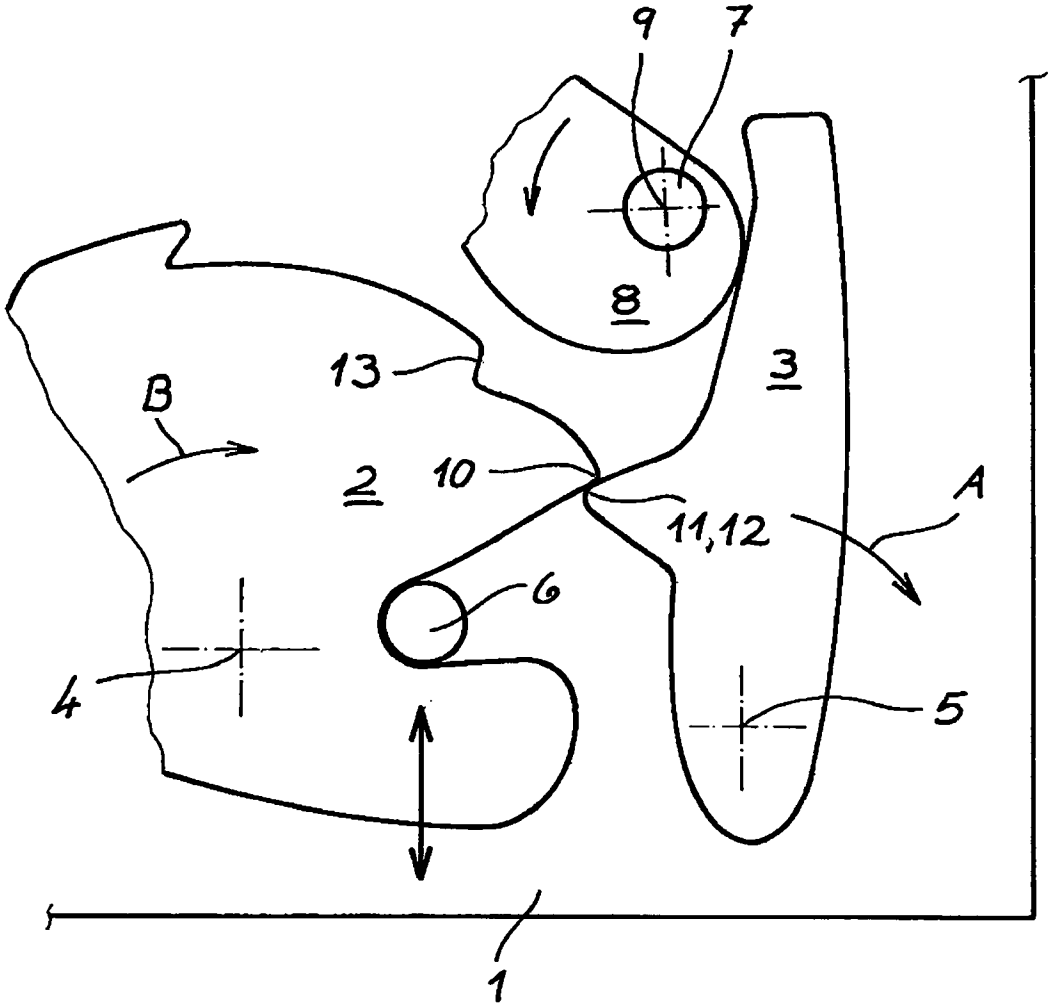
FIG. 1 a diagram of a motor vehicle door latch or its locking mechanism.

FIG. 1 depicts a motor vehicle door latch which has a frame box 1 in which a locking mechanism 2, 3 comprising a catch 2 and a pawl 3 is located. A rotational axis 4 corresponds to the catch 2, whereas the pawl 3 is pivotably located around a rotational axis 5. In addition, another locking bolt 6 is recognised.

The locking mechanism 2, 3 is depicted in the closed state in FIG. 1. In order to open the locking mechanism 2, 3, in the execution example and not restrictedly a drive unit 7, 8 operates on the pawl 3. In the example, the drive unit 7, 8 comprises a motor or electrical motor 7 and an operation cam 8 acted on by the motor 7. The activation cam 8 is overall of a spiral design. Consequently, a rotation around a pertaining axis 9 with the aid of the electrical motor 7 lifts the pawl 3 from the catch 2. In actual fact, the catch 2 is supported in the depicted closed state of the locking mechanism 2, 3 with a ratchet contour 10 on a bolting contour 11, 12 of the pawl 3. The ratchet contour 10 is a main ratchet contour 10 of the catch 2. Furthermore, a pre-ratchet contour 13 is provided for on the catch 2 which is however unimportant for the following observations.

Figure 2:
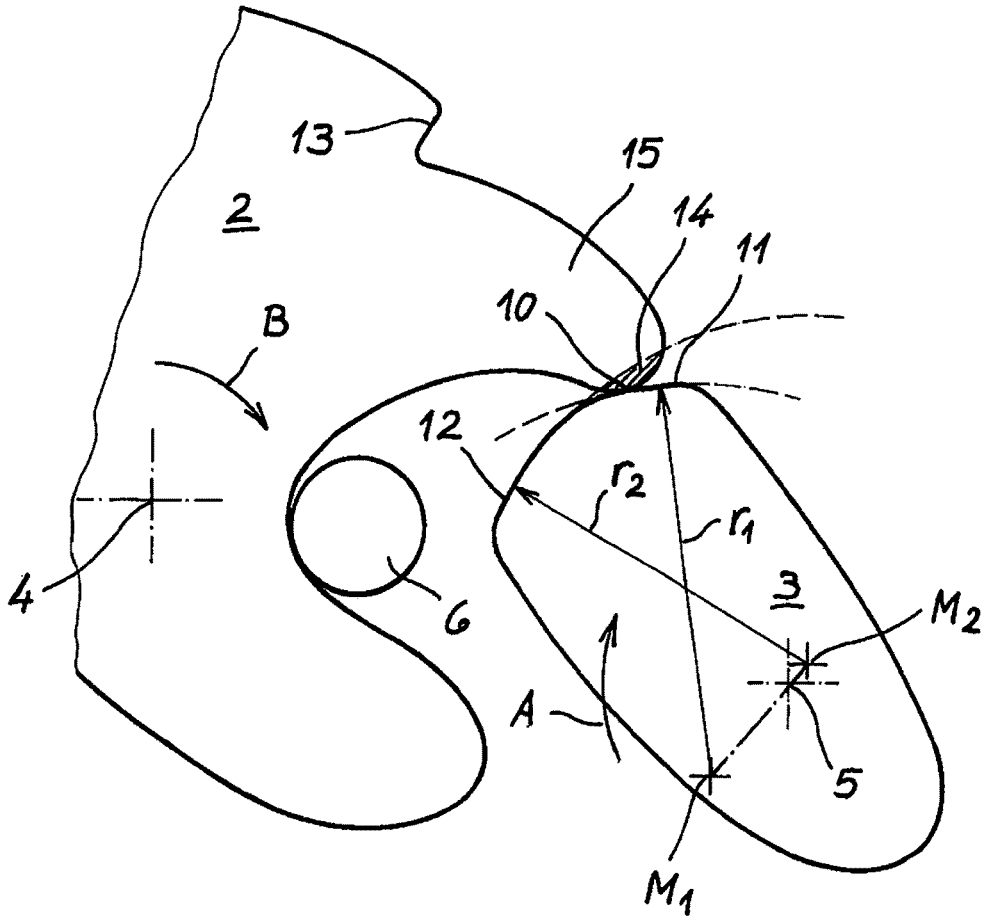
FIG. 2 a modified arrangement of a motor vehicle door latch with a pawl in a closed state.
Figure 4:
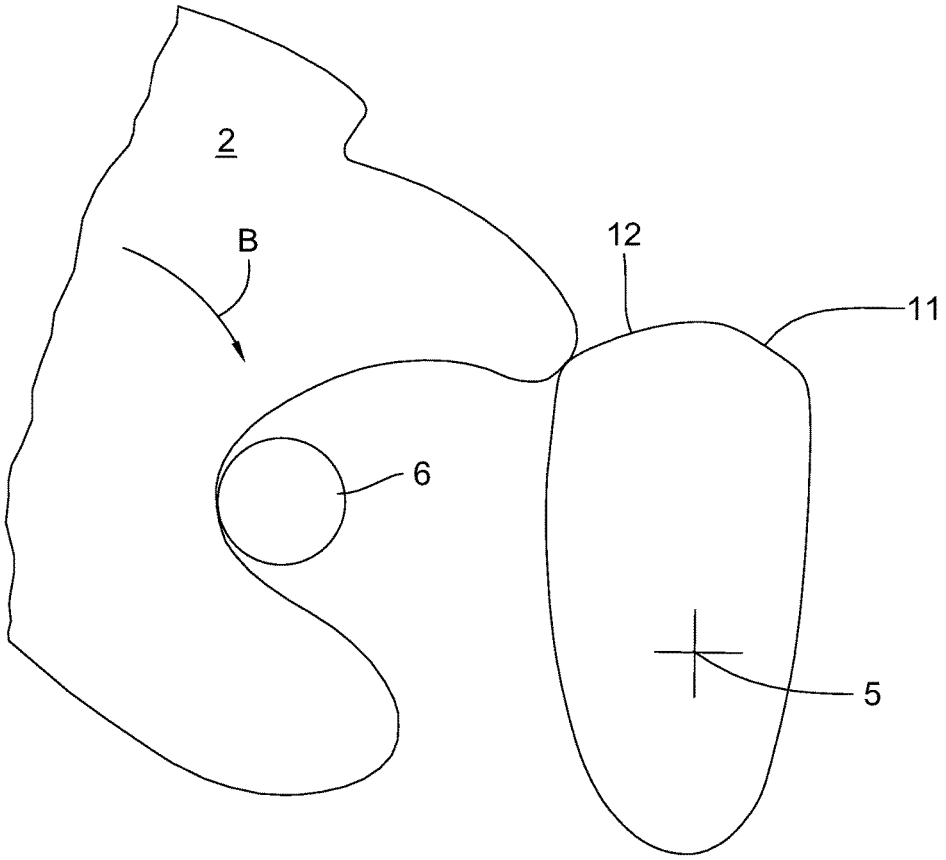
FIG. 4 the motor vehicle door latch of FIG. 2, with the pawl in a nearly lifted off position.

FIG. 2 shows a modified arrangement of the motor vehicle door larch in FIG. 1. In the closed state of the locking mechanism 2, 3 depicted in FIG. 2, the pawl 3 with its bolting contour 11, 12 lies against the ratchet contour or the main ratchet contour 10 of the catch 2. In fact, the catch 2 with the relevant ratchet contour 10 is supported on the bolting contour 11, 12 of the catch. As soon as the pawl 3 is lifted from the catch 2 with the aid of the drive unit (drive unit not shows but movement as shown in FIG. 4) the catch 2 opens in a spring-actuated manner. In this process the catch 2 is pivoted by spring force around its rotational axis 4 in a clockwise direction, as indicated by arrow B in FIG. 2.

For lifting out, the pawl 3 moves around its rotational axis 5 also in a clockwise direction. A lifting out direction A corresponds to this. As soon as the catch 2 reaches its open position, the locking bolt 6 is no longer secured and can be moved in the arrow direction shown in FIG. 2, respectively the locking mechanism 2, 3 and the pertaining latch can be removed from the locking bolt 6. The tailgate accommodates the locking mechanism 2, 3 or the latch in its interior, whereas the locking bolt 6 remains stationary at the loading room sill in the example case.

The bolting contour 11, 12 of the pawl 3 is designed in two parts in accordance with the invention and comprises a holding contour 11 and an unrolling contour 12. The holding contour 11 predominantly interacts in the closed state of the locking mechanism 2, 3 with the ratchet contour or main ratchet contour 10 of the catch 2. In fact, the catch 2 in the closed state of the locking mechanism 2, 3 is supported on precisely this holding contour 11 of the pawl 3 (cf. FIG. 2).

Figure 3:
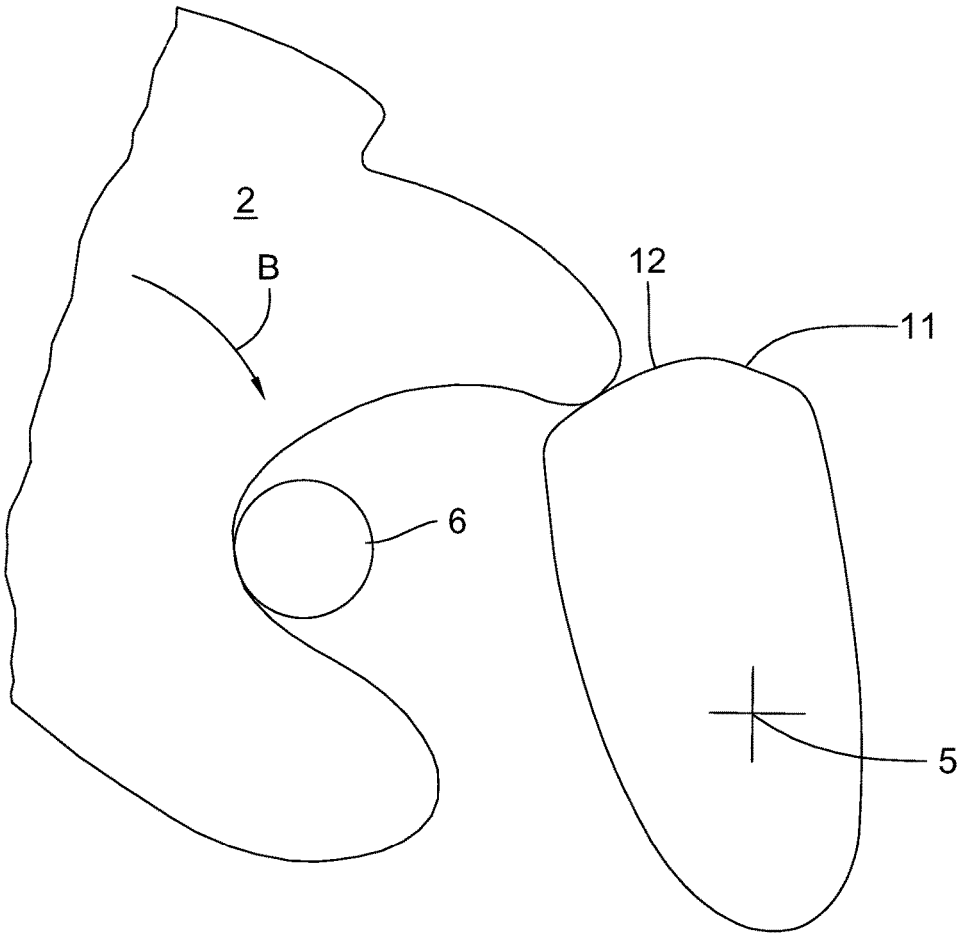
FIG. 3 the motor vehicle door latch of FIG. 2 with the pawl in an unrolling position.

However, if the pawl 3 is acted on by the drive unit 7, 8 in the lift-out direction and thus the opening process initiates the catch 2, an interaction takes place between the unrolling contour 12 and the ratchet contour 10 as shown in FIG. 3. This means that the unrolling contour 12 of the pawl 3 rolls off on the ratchet contour 10 in the opening process of the catch 2 beyond the closed state of the locking mechanism 2, 3. Thus, the catch 2 is lifted off practically noiselessly from the unrolling contour 12.

In order to attain this in detail, as a start, the holding contour 11 and the unrolling contour 12 are arranged on a catch-side end of the pawl 3 and joined to one another. Opposite to this catch side of the pawl 3 lies the rotational axis-side end of the pawl 3, on which the rotational axis 5 of the pawl 3 is located. In fact, the holding contour 11 is connected to the unrolling contour 12 in the lifting-out direction A of the pawl 3. In addition, on the basis of the enlarged sketch in FIG. 2 it is recognised that the unrolling contour 12 at least partially radially protrudes over the holding contour 11 in the corresponding lifting direction A of the pawl 3. At this point, it is observed that the unrolling contour 12 increasingly or progressively radially protrudes over the holding contour 11 in the lifting direction A of the pawl 3. This means that the distance between the unrolling contour 12 and the holding contour 11 also becomes larger with an increasing angle of the pivoting movement of the pawl 3 around its rotational axis 5 in lifting direction A. This is clear on the basis of the respective contours 11, 12 or its extensions illustrated dashed.

The unrolling contour 12 overlaps in the lifting direction A of the pawl 3 with the catch 2 in its closed state at least in part. In fact, at this point an overlap area 14 which is depicted in a hatched manner in FIG. 2 is observed. The unrolling contour 12 and the holding contour 11 are respectively formed as circular arcs. Radii $r_1$, $r_2$ and pertaining centre points $M_1$, $M_2$ correspond to the circular arcs.

The radius r1 belongs to the holding contour 11 and starts from the pertaining centre point M1 of the holding contour 11. The radius r2 corresponds to the unrolling contour 12 and is thrown around the pertaining centre point $M_2$. It is designed in such a way that the respective circular arcs or contours 11, 12 are respectively equipped with different radii $r_1$, $r_2$ and also different centre points $M_1$, $M_2$.

Furthermore, the radius $r_2$ of the unrolling contour 12 exceeds the relevant radius r1 of the holding contour 11. Thus, the bolting contour 11, 12 on the pawl 3 is designed overall in such a way that the bolting contour 11, 12 lags or runs behind so to speak when the pawl 3 is lifted off and consequently the opening movement of the catch 2 of the pertaining ratchet contour 10 on the catch 2.

Thereto contributes the circumstance that the centre point $M_1$ of the holding contour 11 respectively the pertaining circular arc with the radius $r_1$ is arranged below the catch 5 of the pawl 3. In contrast, the centre point $M_2$ of the unrolling contour with the radius $r_2$ is above the rotational axis 5 in question. Both centre points $M_1$, $M_2$ and the rotational axis 5 are overall arranged on a common connection section as FIG. 2 indicates in dot dashes. Of course, this as well as the arrangement of the centre points $M_1$, $M_2$ compared to the rotational axis 5 in the same way, must only be understood as an example and not restrictive.

As soon as the pawl 3 is lifted up from the catch 2, the ratchet contour 10 of the catch 2 veers away from the holding contour 11 of the pawl 3. However, as the unrolling contour 12 of the pawl 3 is connected to the holding contour 11 and is designed with the already described progressively increasing radial distance compared to the holding contour 11, the unrolling contour 12 of the pawl 3 can lag the ratchet contour 10 on the catch 2 so to speak in this opening process. This means that the pawl 3 pivoting around the rotational axis 5 in the lifting direction A and the catch 2 pivoting around its rotational axis 4 supported by a spring in a clockwise direction glide along one another unchanged by the unrolling contour 12 now interacting with the ratchet contour 10 and if necessary a leg 15 of the catch 2. Catch 2 contacting unrolling contour 12 is illustrated in FIG. 3. At the end of this gliding interaction the catch 2 and the pawl 3 veer away from one another with a slowly increasing distance. Consequently, practically no troublesome noises are associated with this separation process. FIG. 4 illustrates catch 2 at the end of unrolling contour 12.

The invention claimed is:

1. A motor vehicle door latch, with a locking mechanism comprising a catch and a pawl having a bolting contour, whereby the pawl is adjacent to a ratchet contour of the catch, with its bolting contour in a closed state of the locking mechanism wherein the bolting contour is designed in two parts with a holding contour and an unrolling contour, whereby the holding contour predominantly interacts in the closed state of the locking mechanism with the ratchet contour, whereas the unrolling contour is positioned to interact with the ratchet contour when the pawl is moved in an opening direction from the closed state;

wherein the unrolling contour and the holding contour are respectively designed as circular arcs;

wherein the circular arcs are equipped with different length radii and centre points;

wherein the centre point of the unrolling contour and the centre point of the holding contour are at a distance from one another; and wherein the centre point of the holding contour is arranged on an unrolling contour side of a rotational axis of the pawl and the centre point of the unrolling contour is arranged on a holding contour side of the rotational axis.

2. The motor vehicle door latch in accordance with claim 1, wherein the holding contour on the unrolling contour and the catch-side end of the pawl connect to one another.

3. The motor vehicle door latch in accordance with claim 2, wherein the unrolling contour is connected to the holding contour in a lifting-out direction of the pawl.

4. The motor vehicle door latch in accordance with claim 3, wherein an arc defined by the unrolling contour protrudes at least partially radially over the holding contour in the lifting-out direction of the pawl.

5. The motor vehicle door latch in accordance with claim 4, wherein an arc defined by the unrolling contour protrudes increasingly or progressively radially over the holding contour in the lifting-out direction of the pawl.

6. The motor vehicle door latch in accordance with claim 5, wherein the unrolling contour at least partially overlaps in the lifting out direction of the pawl with the catch in its closed state.

7. The motor vehicle door latch in accordance with claim 4, wherein the unrolling contour at least partially overlaps in the lifting out direction of the pawl with the catch in its closed state.

8. The motor vehicle door latch in accordance with claim 3, wherein an arc defined by the unrolling contour at least partially overlaps in the lifting out direction of the pawl with the catch in its closed state.

9. The motor vehicle door latch in accordance with claim 8, wherein the unrolling contour overlaps in the lifting out direction of the pawl with the ratchet contour and if necessary the limb of the catch in its closed state.

10. The motor vehicle door latch in accordance with claim 1, wherein the radius of the unrolling contour exceeds the radius of the holding contour.

11. The motor vehicle door latch in accordance with claim 1, wherein the centre point of the holding and the centre point of the unrolling contour are arranged on a common connection section that intersects the rotational axis of the pawl.

12. The motor vehicle door latch in accordance with claim 1, wherein a drive unit is assigned to the pawl for its motorised lifting-out.

13. The motor vehicle door latch in accordance with claim 12, wherein the drive unit works with an activation cam on the pawl.

14. The motor vehicle door latch in accordance with claim 1, wherein the ratchet contour is on a limb of the catch.

15. A motor vehicle door latch with a locking mechanism comprising:

a catch defining a ratchet contour, wherein the catch is rotatable between an open state and a closed state; and a pawl defining an axis of rotation and a bolting contour having a holding contour and an unrolling contour, wherein the bolting contour engages the ratchet contour to hold the catch in a closed state, wherein, in the closed state, the ratchet contour engages the holding contour portion of the bolting contour and wherein, rotating the pawl in an opening direction moves the engagement of the ratchet contour from the holding contour portion of the bolting contour to the unrolling contour portion of the bolting contour;

wherein the holding contour is a first circular arc having a first radius and a first centre point;

wherein the unrolling contour is a second circular arc having a second radius and a second centre point;

wherein the first and second radiuses are not the same length; and wherein the first centre point is arranged on an unrolling contour side of the axis of rotation of the pawl and the second centre point is arranged on a holding contour side of the axis of rotation of the pawl, opposite the unrolling contour side.

16. The motor vehicle door latch of claim 15, wherein a distance between a point where the ratchet contour engages the bolting contour progressive increases along the holding contour when rotating the pawl in an opening direction along the holding contour.

17. The motor vehicle door latch of claim 15, wherein the second radius is greater than the first radius.

18. The motor vehicle door latch of claim 15, wherein the unrolling contour is further away from the axis of rotation of the pawl than the holding contour.

19. The motor vehicle door latch of claim 15, wherein the unrolling contour is configured to minimize noise between the catch and the pawl when the pawl is lifted off the catch.

20. The motor vehicle door latch of claim 15, wherein the second centre point is closer to the axis of rotation of the pawl than the first centre point.

* * * * *